US011123987B2

(12) United States Patent
Ibe et al.

(10) Patent No.: US 11,123,987 B2
(45) Date of Patent: Sep. 21, 2021

(54) LIQUID EJECTION HEAD AND METHOD OF MANUFACTURING LIQUID EJECTION HEAD

(71) Applicant: CANON KABUSHIKI KAISHA, Tokyo (JP)

(72) Inventors: Satoshi Ibe, Yokohama (JP); Takanobu Manabe, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/560,467

(22) Filed: Sep. 4, 2019

(65) Prior Publication Data

US 2020/0079084 A1 Mar. 12, 2020

(30) Foreign Application Priority Data

Sep. 7, 2018 (JP) ..... JP2018-168181

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1629* (2013.01); *B41J 2002/14419* (2013.01)

(58) Field of Classification Search
None
See application file for complete search history.

(56) References Cited

U.S. PATENT DOCUMENTS

| | | | | |
|---|---|---|---|---|
| 6,648,454 | B1 | 11/2003 | Donaldson et al. | |
| 7,238,293 | B2 | 7/2007 | Donaldson et al. | |
| 7,857,429 | B2 | 12/2010 | Ozaki et al. | |
| 8,177,988 | B2 | 5/2012 | Komiyama et al. | |
| 8,267,503 | B2 | 9/2012 | Koyama et al. | |
| 8,286,351 | B2 | 10/2012 | Edamatsu et al. | |
| 8,388,106 | B2 | 3/2013 | Kurosu et al. | |
| 8,613,862 | B2 * | 12/2013 | Asai | B41J 2/1623 216/27 |
| 9,085,141 | B2 | 7/2015 | Oya et al. | |
| 9,162,459 | B2 | 10/2015 | Nagai et al. | |
| 9,211,715 | B2 | 12/2015 | Ibe et al. | |
| 2014/0333695 | A1 * | 11/2014 | Amma | B41J 2/14145 347/20 |
| 2015/0328891 | A1 * | 11/2015 | Watanabe | B41J 2/14145 347/44 |
| 2016/0059551 | A1 * | 3/2016 | Miyazaki | B41J 2/14145 347/57 |
| 2017/0341397 | A1 * | 11/2017 | Otsuka | B41J 2/1628 |
| 2017/0341404 | A1 * | 11/2017 | Nakagawa | B41J 2/17553 |
| 2018/0326723 | A1 | 11/2018 | Manabe et al. | |

FOREIGN PATENT DOCUMENTS

JP 2004-148824 A 5/2004

* cited by examiner

*Primary Examiner* — Erica S Lin
*Assistant Examiner* — Tracey M McMillion
(74) *Attorney, Agent, or Firm* — Venable LLP

(57) ABSTRACT

In a liquid ejection head and a method of manufacturing the ejection head, an ejection port board is provided with an expanded portion that communicates with a supply port and has an open end that is larger than an opening of the supply port.

9 Claims, 4 Drawing Sheets

LIQUID EJECTION HEAD AND METHOD OF MANUFACTURING LIQUID EJECTION HEAD

BACKGROUND OF THE INVENTION

Field of the Invention

The present invention relates to a liquid ejection head configured to perform printing by ejecting a liquid, and to a method of manufacturing the liquid ejection head.

Description of the Related Art

Various silicon devices have been applied to devices including inkjet printing heads in recent years. Microfabrication techniques equivalent to micromachining techniques are used for manufacturing such silicon devices.

Japanese Patent Laid-Open No. 2004-148824 discloses an inkjet printing head in which a board that includes flow passages prepared by forming multiple ejection energy generation members on a silicon substrate, ejection ports to eject a liquid, and supply ports to supply an ink to the ejection ports, is attached to a support member that includes an ink supply system, thereby holding the board and the support member together.

SUMMARY OF THE INVENTION

A liquid ejection head according to the present invention includes: an ejection port forming member including an ejection port provided capable of ejecting a liquid, and a pressure chamber communicating with the ejection port; a silicon substrate including a supply port provided capable of supplying the liquid to the pressure chamber; and a flow passage member made of a resin, including a flow passage to be connected to the supply port, and joined to the silicon substrate. Here, the silicon substrate includes an expanded portion located at an opening of the supply port to be connected to the flow passage and formed by expanding a member that constitutes the opening outward from a periphery of the opening at least to one side in such a way as to be recessed from the opening in a direction of extension of the supply port.

Further features of the present invention will become apparent from the following description of exemplary embodiments with reference to the attached drawings.

DESCRIPTION OF THE EMBODIMENTS

Figure 1A:
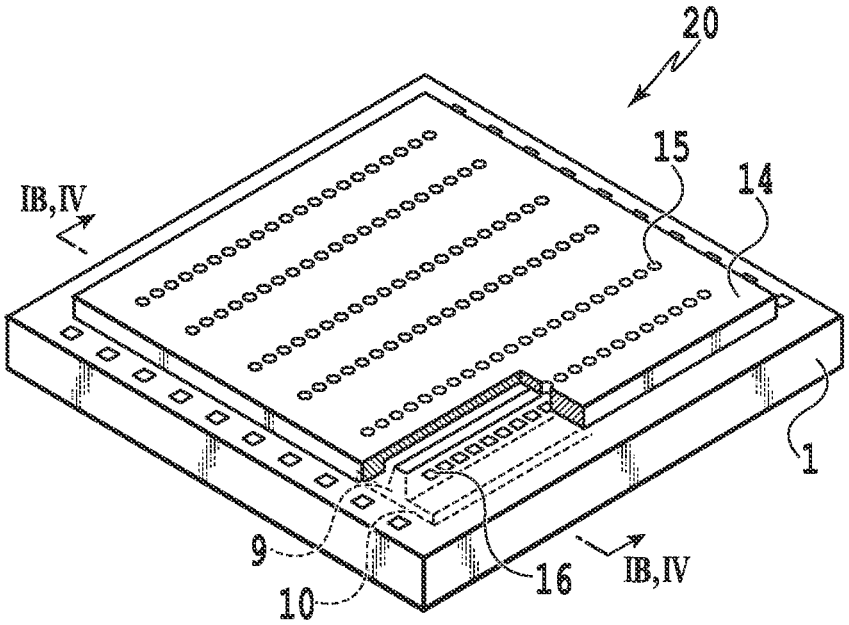
FIG. 1A is a diagram showing a board in a liquid ejection head.

In the configuration according to Japanese Patent Laid-Open No. 2004-148824, there may be a case where a pitch of the supply ports is reduced for the purpose of shrinking the board so as to provide the liquid ejection head with higher precision at a lower price. In this case, it is also necessary to reduce a pitch of the flow passages provided in a flow passage member, attached to the board, for supplying the liquid to the board in accordance with the pitch of the supply ports in the board. The flow passage member is generally formed by injection molding. The injection molding has a limitation in reducing a thickness of a resin that constitutes a wall between the flow passages which is deemed to be about 0.5 mm at most. Thus, reduction of the pitch of the flow passages provided in the flow passage member is limited. As a consequence, it is difficult to reduce the size of the flow passage member.

Hence, the flow passage member can hardly be molded in conformity to the board reduced in size, and it is difficult to provide a lower price liquid ejection head at reduced costs by increasing an available quantity of the boards (the number of the boards available from one wafer).

Given the situation, the present invention aims to provide a lower price liquid ejection head and a method of manufacturing the liquid ejection head.

Embodiments of the present invention will be described below with reference to the drawings. In the following description, structures having the same functions may be denoted by the same reference numerals in the drawings and overlapping explanations may be omitted as appropriate.

Figure 1B:
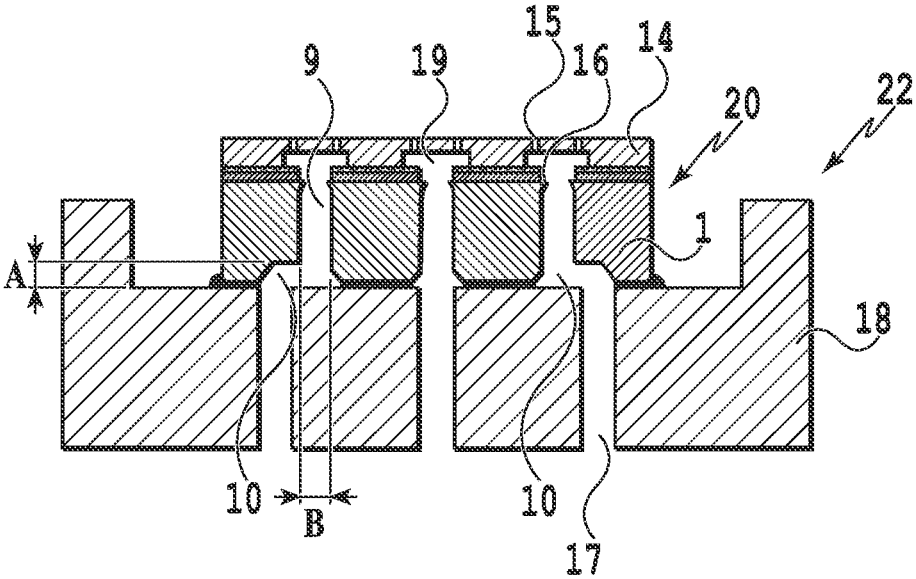
FIG. 1B is another diagram showing the board in the liquid ejection head.

FIG. 1A is an overall perspective view of an ejection port board 20 within a board 22, and FIG. 1B is a cross-sectional view of the board 22 taken along the IB-IB line across the ejection port board 20 in FIG. 1A, in which the board 22 is obtained by joining a flow passage member 18 to the ejection port board 20. The ejection port board 20 includes an ejection port forming member 14 provided with multiple ejection ports 15, and a silicon substrate 1 provided with heaters 16 serving as ejection energy generation members and not-illustrated electric wiring as well as with supply ports 9. The ejection port forming member 14 is provided with the ejection ports 15 and pressure chambers 19 communicating with the ejection ports 15.

The pressure chambers 19 can receive heat generated by the heaters 16 by forming the ejection port forming member 14 on the silicon substrate 1. Meanwhile, the heaters 16 are located face to face to the ejection ports 15 by forming the ejection port forming member 14 on the silicon substrate 1. Thus, it is possible to eject a liquid heated by the heaters 16 from the ejection ports 15. Moreover, by forming the ejection port forming member 14 on the silicon substrate 1, the pressure chambers 19 communicate with supply ports 9 in the silicon substrate 1 whereby the liquid supplied from the supply ports 9 flows into the pressure chambers 19.

The ejection port board 20 is joined to the flow passage member 18 with an adhesive in such a way that the supply ports 9 in the ejection port board 20 communicate with flow passages 17 in the flow passage member 18. Each supply port 9 can supply the liquid to the pressure chamber 19 and the ejection port 15 corresponding thereto. The liquid flowing out of the flow passage 17 enters the pressure chamber 19 through the supply port 9, and is ejected from the ejection port 15 by the action of the heater 16. The flow passage member 18 is a resin member formed by injection molding, which is molded by injecting a resin into a mold.

An expanded portion 10 is formed at an open end portion on the flow passage member 18 side of each supply port 9 in the silicon substrate 1. The expanded portion 10 is formed by expanding an opening of the supply port 9, to which the flow passage 17 is connected, outward (on at least one side) from the periphery thereof. An open end portion of the expanded portion 10 includes a larger opening than the opening of the supply port 9. The expanded portion 10 is a portion recessed in a direction of extension (which is an up-down direction in FIG. 1B) of the supply port 9 from its opening. Specifically, the expanded portion 10 has a prescribed depth in a direction from the open end portion of the expanded portion 10 to the supply port 9 (the direction of extension of the supply port). Assuming that a height of the expanded portion 10 in the direction of extension of the supply port 9 is A and a width of the supply port 9 is B, a relation $0.9B \leq A \leq 1.1B$ is preferably satisfied. Moreover, it is preferable that the expanded portion 10 includes a surface extending along a joint surface of the silicon substrate 1 with the flow passage member 18. Such a surface is more preferably a surface that is substantially parallel to the joint surface.

By providing the expanded portion 10 as described above, it is possible to secure the flow passages at a junction between the silicon substrate 1 and the flow passage member 18 in the ejection port board 20 even if the pitch of the supply ports 9 is narrower than the pitch of the flow passages 17. Moreover, since the expanded portion 10 is provided, it is possible to establish communication between each supply port 9 with the corresponding flow passage 17 while minimizing the reduction in width of each flow passage.

Note that the silicon substrate 1 discussed herein includes three supply ports 9 and the supply port 9 located at the center is also provided with the expanded portion 10. In this way, even if a displacement occurs in the case of joining the silicon substrate 1 to the flow passage member 18 in the ejection port board 20, this configuration can make up for such a displacement.

Now, a manufacturing process for the ejection port board 20 will be described below in the order of steps while involving a specific example therein.

Figure 2A:
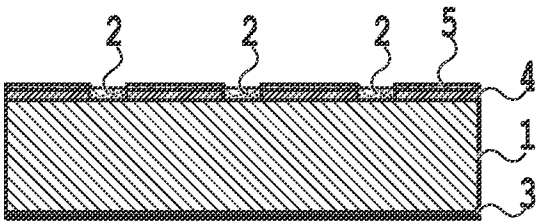
FIGS. 2A to 2F are diagrams showing a manufacturing process for the board.
Figure 2B:
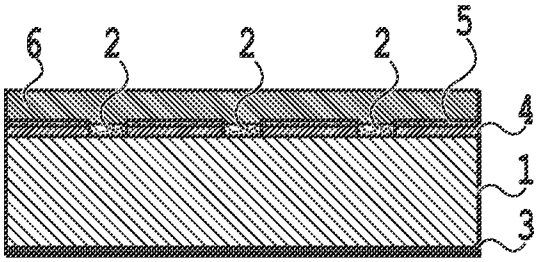

FIGS. 2A to 2F are diagrams showing the manufacturing process for the ejection port board 20. First, as shown in FIG. 2A, dimensions for the supply ports on a top surface side of the substrate are determined on the silicon substrate 1. For example, aluminum sacrifice layers 2 are provided at portions on the top surface side where the supply ports are to be formed, and protection films 3 such as thermally oxidized films collectively serving as a mask for patterning the supply ports on a back surface side are provided on the back surface side. Thereafter, a mask material 6 is coated as shown in FIG. 2B so as to avoid damage on the surface inclusive of an insulating film 4 made of SiN and the like as well as an adhesion improving layer 5, and so forth which are patterned in advance in the case where the silicon substrate 1 is immersed in a strong alkaline etchant used in a process for forming the supply ports.

Figure 2C:
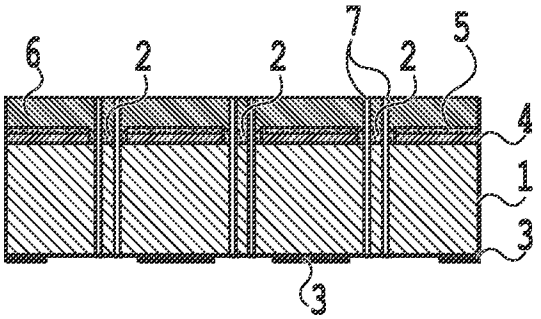

Next, as shown in FIG. 2C, through holes 7 are formed by using a YAG laser, for example, so as to pierce the mask material 6 and the silicon substrate 1. In this step, each through hole 7 is formed by being irradiated with a 220-pulse laser, for example. Meanwhile, an opening for determining the position of the supply port on the back surface side is patterned in such a way as to scrape the protection film 3 of the thermally oxidized film or the like deposited on the back surface of the substrate using the laser. Here, the opening may be formed by a patterning method other than the one using the laser.

Figure 2D:
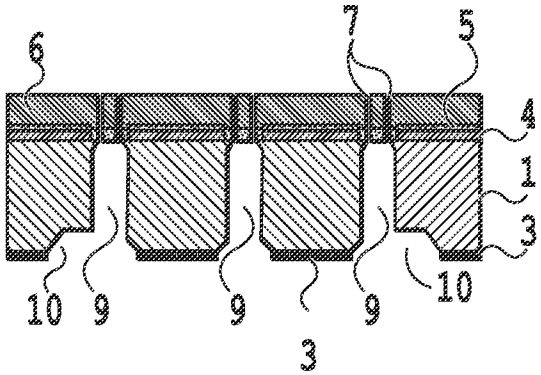

Then, as shown in FIG. 2D, the silicon substrate 1 provided with the through holes 7 is immersed in a tetramethylammonium hydroxide (TMAH) aqueous solution (22% concentration) at 83° C. for two to three hours and is thus subjected to anisotropic wet etching. In this way, the supply port 9 penetrating the silicon substrate 1 is formed. In this case, the openings of the supply ports 9 on the back side are patterned in such a way as to be shifted at prescribed lengths from the centers of the openings on the top surface side in advance. Thus, it is possible to form the expanded portion 10 on the back surface side of each supply port 9 together with (simultaneously with) the supply port 9 by the anisotropic etching. By providing the expanded portions 10 in accordance with the above-described step (an expanded portion forming step), it is possible to establish the communication of the flow passages formed at a wider pitch than the pitch of the supply ports 9 without having to narrow down the flow passages at the junction in the case where the silicon substrate is joined to the flow passage member.

Figure 2E:
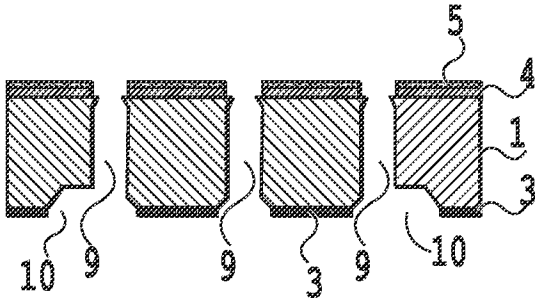

Thereafter, as shown in FIG. 2E, the mask material 6 which is not necessary any more is removed by immersing the mask material 6 in a dedicated remover liquid for a prescribed period. After the removal of the mask material 6, a tape 21 that is a resin for forming the ejection ports 15 is attached as shown in FIG. 2F by using a spin-coating method.

Figure 2F:
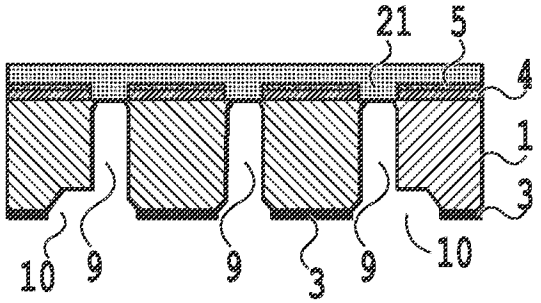
Figure 3A:
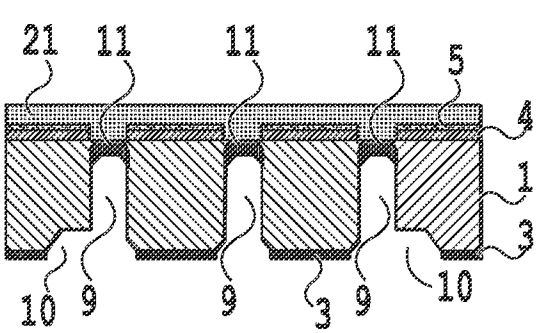
FIGS. 3A to 3F are more diagrams showing the manufacturing process for the board.

FIGS. 3A to 3F are diagrams showing the manufacturing process for the board subsequent to FIG. 2F. As shown in FIG. 3A, the supply ports 9 on the back surface of the silicon substrate 1 are filled with a filler material 11 and the filler material 11 is subjected to thermal curing. In order to allow subsequent coating of an ejection port forming material that contains an organic solvent as a main solvent, a material such as a polyvinyl alcohol (PVA) aqueous solution is selected as the filler material 11 because PVA has resistance to the solvent and is easily removable with water. If it is desired to leave only a solid content in the PVA aqueous solution after the thermal curing at a thickness of about 20 μm inside the supply ports 9, the PVA aqueous solution at a solid content concentration in a range from 25% to 30% should be put into the supply ports 9 by use of a highly accurate dispensing technique.

Figure 3B:
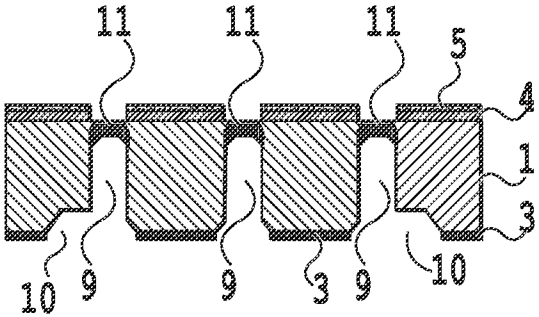
Figure 3C:
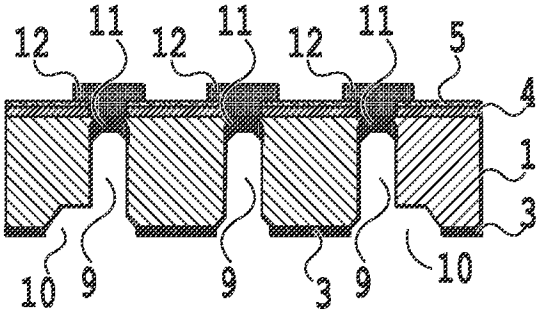
Figure 3D:
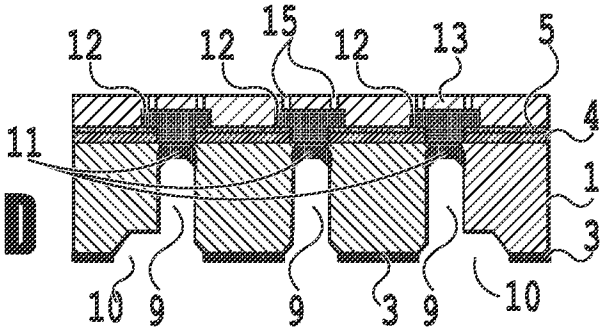

After putting the filler material 11 in, the filler material 11 is irradiated with ultraviolet rays at 200 mJ or higher from above the tape 21 and is thus peeled off as shown in FIG. 3B. In this instance, it is possible to confirm the filler material 11 from each supply port 9 on the top surface. Thereafter, as shown in FIG. 3C, mold materials 12 for forming the pressure chambers 19 are formed into a desired pattern by use of photolithography. In this case, it is possible to form the mold materials 12 without leaking out to the supply ports 9 since the supply ports 9 are closed with the filler material 11. Then, as shown in FIG. 3D, the ejection port forming member 14 for forming the ejection ports 15 is coated at a desired thickness on the mold materials 12, and then the ejection ports 15 are formed by performing exposure and development. In this case, it is also possible to form the ejection ports in stable shapes by employing an alkaline developer used for patterning the ejection ports 15 thanks to the resistance of PVA to the solvent.

Figure 3E:
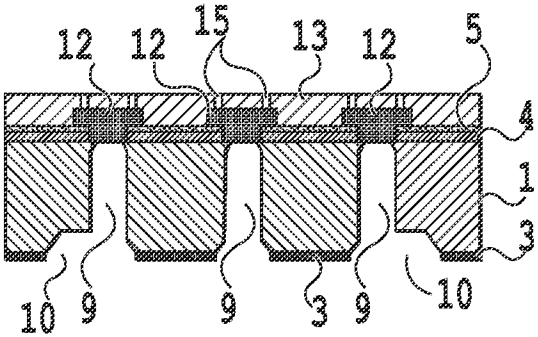
Figure 3F:
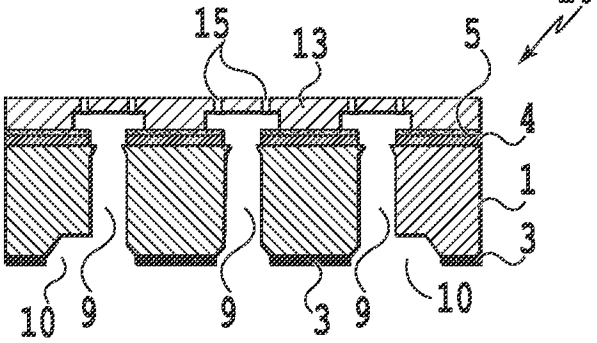

As shown in FIG. 3E, the filler material 11 formed from the unnecessary PVA is removed by immersing the filler material in water for a predetermined period, and then a drying process is conducted. Lastly, as shown in FIG. 3F, the unnecessary mold materials 12 are immersed in a dedicated remover for a predetermined period and are thus removed. Hence, the flow passages pass completely through from the back surface side to the ejection ports 15 and the ejection port board 20 is thus finished.

In this embodiment, each expanded portion 10 is provided in such a way as to expand to the end portion side of the substrate at the opening of the supply port 9 that is formed at the end portion of the silicon substrate 1 (the ejection port board 20). However, the present invention is not limited only to this configuration. The expanded portion 10 may be provided at the opening of the supply port 9 concentrically with the supply port 9 in such a way as to simply increase an opening area of the supply port 9.

Alternatively, a supply port 9 located closer to a side surface of the silicon substrate 1 (the ejection port board 20) may be provided with an expanded portion 10 with a larger opening area. The side surface of the silicon substrate 1 means a left or right side surface of the silicon substrate 1 in FIG. 1B. The opening area of the supply port 9 is the area of the opening of the supply port 9 on the back surface of the silicon substrate 1 in the case where the supply port 9 in FIG. 1B is viewed from below.

As described above, the provision of the expanded portion to the opening of the supply port in the ejection port board makes it possible to realize a lower price liquid ejection head and a method of manufacturing the liquid ejection head.

Other Embodiments

Figure 4:
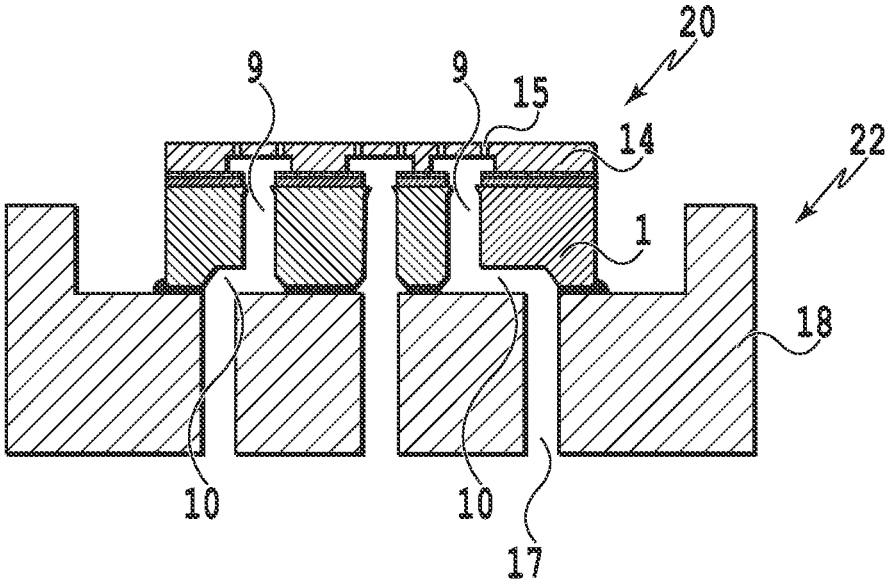
FIG. 4 is a diagram showing a board of another embodiment.

FIG. 4 is a diagram showing a substrate of another embodiment. Although the three supply ports are arranged symmetrically in the above-described embodiment, the supply ports 9 may be arranged asymmetrically with respect to the center line of the silicon substrate 1 in a direction of an array of the ejection ports as shown in FIG. 4. If the supply ports 9 are arranged asymmetrically as mentioned above, it is still possible to establish the communication between each flow passage 17 with the corresponding supply port 9 by providing the expanded portion 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-168181 filed Sep. 7, 2018, which is hereby incorporated by reference herein in its entirety.

What is claimed is:

1. A liquid ejection head comprising:

an ejection port forming member including an ejection port capable of ejecting a liquid and a pressure chamber communicating with the ejection port;

a silicon substrate including a plurality of supply ports capable of supplying the liquid to the pressure chamber; and a flow passage member made of a resin, including a plurality of flow passages to be connected to the supply ports, and joined to the silicon substrate, wherein each of the plurality of supply ports is connected to one of the flow passages, the silicon substrate includes an expanded portion located at an opening of at least one of the supply ports to be connected to a corresponding one of the flow passages and formed by expanding a member that constitutes the opening outward from a periphery of the opening at least to one side in such a way as to be recessed from the opening in a direction of extension of the at least one supply port, and of the plurality of the supply ports, the supply port located closer to a side surface of the silicon substrate in a direction orthogonal to a stacking direction of the ejection port forming member and the silicon substrate has an opening area larger than that of a different supply port located farther from the side surface.

2. The liquid ejection head according to claim 1, wherein the expanded portion includes a surface extending along a joint surface of the substrate with the flow passage member.

3. The liquid ejection head according to claim 1, wherein the liquid ejection head satisfies $$0.9B \leq A \leq 1.1B,$$

where A is a height of the expanded portion in the direction of extension of the at least one supply port and B is a width of the at least one supply port.

4. The liquid ejection head according to claim 1, wherein a plurality of the ejection ports are formed in an array, and the supply ports are provided along the array of the ejection ports.

5. The liquid ejection head according to claim 4, wherein the plurality of the supply ports are arranged asymmetrically with respect to a center line of the substrate in a direction of the array of the ejection ports.

6. The liquid ejection head according to claim 1, wherein a pitch of a plurality of the flow passages provided in the flow passage member is wider than a pitch of the plurality of the supply ports provided in the silicon substrate.

7. A method of manufacturing a liquid ejection head including an ejection port forming member including an ejection port capable of ejecting a liquid and a pressure chamber communicating with the ejection port, a silicon substrate including a plurality of supply ports capable of supplying the liquid to the pressure chamber, and a flow passage member made of a resin, including a plurality of flow passages to be connected to the supply ports, and joined to the silicon substrate, with each of the plurality of supply ports being connected to one of the flow passages, the method comprising:

an expanded portion forming step of forming an expanded portion located at an opening of at least one of the supply ports of the silicon substrate to be connected to a corresponding one of the flow passages and formed by expanding a member that constitutes the opening outward from a periphery of the opening at least to one side in such a way as to be recessed from the opening in a direction of extension of the at least one supply port, wherein of the plurality of the supply ports, the supply port located closer to a side surface of the silicon substrate in a direction orthogonal to a stacking direction of the ejection port forming member and the silicon substrate has an opening area larger than that of a different supply port located farther from the side surface.

8. The method of manufacturing a liquid ejection head according to claim 7, wherein the expanded portion is formed by anisotropic wet etching.

9. The method of manufacturing a liquid ejection head according to claim 7, wherein the expanded portion is formed together with the at least one supply port.

* * * * *